United States Patent [19]

Karlovits

[11] 4,181,244

[45] Jan. 1, 1980

[54] ICE CUBE DISPENSER WITH ROTOR FEED MEANS

[75] Inventor: Frank K. Karlovits, Arlington Heights, Ill.

[73] Assignee: Eaton Corporation, Cleveland, Ohio

[21] Appl. No.: 946,927

[22] Filed: Sep. 28, 1978

Related U.S. Application Data

[63] Continuation of Ser. No. 784,226, Apr. 4, 1977, abandoned.

[51] Int. Cl.[2] ..... G01F 1/06

[52] U.S. Cl. ..... 222/227

[58] Field of Search ..... 222/227, 242, 233; 62/344

[56] References Cited

U.S. PATENT DOCUMENTS

| | | | |
|---|---|---|---|
| 2,369,508 | 2/1945 | White | 222/227 |
| 3,075,363 | 1/1963 | Conto | 62/344 X |

*Primary Examiner*—Stanley H. Tollberg

*Attorney, Agent, or Firm*—R. J. McCloskey; R. A. Johnston; E. Crist

[57] ABSTRACT

A dispenser for storing and dispensing ice cubes in a dispensed condition substantially free of ice chips. An electric motor driven gear train is mounted in the bottom of the ice dispenser storage bin and terminates in an output pinion which engages with a shaft mounted rotor member. The rotor member rotates about a vertical axis and includes an upper spider like section having a plurality of circumferentially spaced radially extending arms which function to maintain the stored ice cubes in a loose condition. The rotor includes a flanged rotor section adjacent the bottom of the storage bin having a plurality of radially extending rib members on its top surface. A dispensing chute is tangentially aligned with respect to the rib portion of the lower rotor section and also the hub surface of the rotor and functions to channel the loosened ice cubes therethrough. The dispenser further includes an inclined agitator member having one end thereof pivotally mounted near the upper end of the storage bin with its lower end engaging either, as disclosed in a first embodiment, a cam for transferring reciprocal motion thereto, or as disclosed in a second embodiment, one end of the reciprocating pivotally mounted lever driven by a cam member mounted on the rotor. The agitating member and the bottom of the storage bin are inclined downwardly toward the rotor member while openings in the bottom surface of the storage bin immediately under the rotor member permit the ice chips to fall therethrough.

9 Claims, 3 Drawing Figures

ICE CUBE DISPENSER WITH ROTOR FEED MEANS

This is a continuation of application Ser. No. 784,226, filed Apr. 4, 1977, now abandoned.

BACKGROUND OF THE INVENTION

1. Field of the Invention

In one aspect, this invention relates to ice dispensers.

In a further aspect, this invention relates to ice storage and dispensing in home refrigerators.

2. Description of the Prior Art

Ice dispensers for dispensing ice through a chute on a refrigerator door are known. Such devices will dispense ice on demand and have gained acceptance in the marketplace. One such known dispenser has an ice container with a fixed dispensing chute. A screw auger is disposed longitudinally within the container and moves the cubes to the dispensing chute when activated.

One example of an ice dispenser is shown in U.S. Pat. No. 3,798,923 issued to Pink, et al. This patent discloses a dispenser having a mullion which forms a part of the storage compartment of the ice dispenser.

A further example of a prior art system is exemplified by U.S. Pat. No. 3,968,906 issued to Kochendorfer, et al. This ice dispenser has a storage bin with a chute and dispensing opening. An elongated ram is positioned within the bin and adapted for reciprocal motion along the longitudinal axis of the bin to move ice within the bin to the dispensing area. However it is possible in certain of the prior art dispensers to activate the unit while the operator's hand is in the storage bin, such as during cleaning. The operator's hand could then be injured by exposed fast-moving parts. This is particularly true of auger type dispensers because the augers often have sharp edges which can pinch or cut fingers. Also, the fast-moving parts result in a substantial amount of noise when the dispenser is operated.

A further problem is a failure on the part of prior art devices to insure that ice in the bin is properly recycled within the storage bin. Therefore, the ice cubes can fuse together and grow stale. This failure to recycle has necessitated cleaning of the bin from time to time to remove ice which is old, or breaking up the frozen cubes and mixing them with other ice in the storage bin.

Yet a further problem is the formation of ice chips in cube dispensers. Ice chips from the cubes are produced in substantial quantities during dispensing of ice cubes due to rapid movement of the cubes caused by the ice dispenser operating at a high speed, and are dispensed by the dispenser even when not desired.

SUMMARY OF THE INVENTION

It is an object of this invention to provide an ice dispenser which quickly dispenses ice with a minimum of chip formation.

It is a further object of this invention to provide an ice dispenser which will dispense ice on a rotating basis from a bin so as to prevent the cubes from freezing into a solid mass.

It is a further object to provide an ice dispenser wherein the storage bin can be removed for cleaning.

These and other objects of the invention will become apparent from the following description.

In general, the ice dispenser of this invention has a storage bin mounted on a shelf, and a removable discharge port or chute adapted to dispense ice. Within the bin is mounted a removable rotor which will turn when driven by a drive means. The rotor provides a device which moves the ice to the discharge chute. The rotor is generally located near the bottom of the storage bin so that the oldest ice is dispensed first. Also, by locating the dispensing chute near the edge of the rotor, the speed of the ice near the periphery is quite high so there is rapid dispensing of ice but the general mass of ice is exposed to only a member passing at low speed, so there is little chipping.

The low rotor speed makes the device safe even if the device is activated while a person's hand is in the storage bin, since the low rotor speed makes injury unlikely.

DETAILED DESCRIPTION OF THE PREFERRED EMBODIMENT

Figure 1:
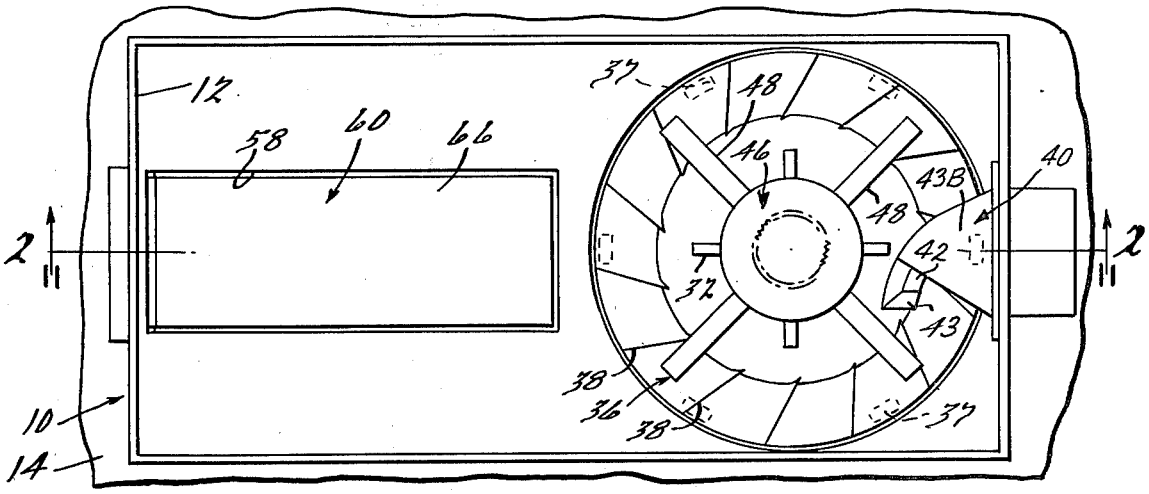
FIG. 1 is a top view of one embodiment of this invention.
Figure 2:
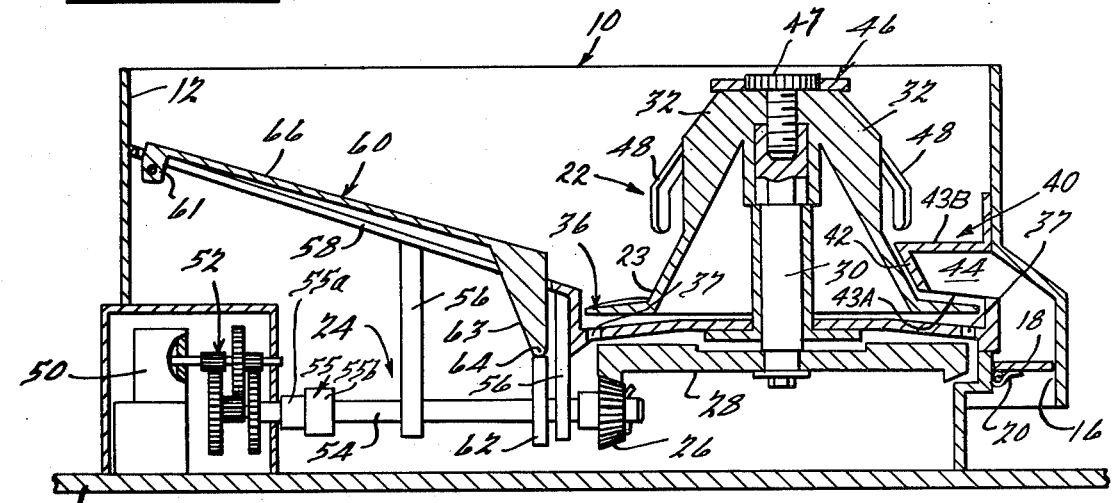
FIG. 2 is a side view, in section, of FIG. 1 taken along line 2—2.

Referring to the accompanying drawing and initially to FIGS. 1 and 2, an icemaker designated generally 10 has a storage bin 12 firmly attached to a base member 14 which will generally be a solid freezer shelf. The bin could be permanently attached by using rails attached to the shelf when such fastening is desired. The storage bin 12 can be placed so as to receive ice produced by an automatic ice maker such as those often found in home refrigerators.

The storage bin 12 has a discharge port 16 located at one end. The discharge port 16 is normally closed by a door 18 which is biased into the closed position by a spring 20, counter balancing a solenoid or other mechanical closure means. The door is shown in a horizontal position; however, it could also be pivoted at the top and be disposed in a vertical position. In either position, the door would prevent warm air from entering the storage bin. This allows the dispenser of this invention to operate without the use of complex closure mechanisms in the refrigerator door.

A removable rotor identified generally by numeral 22, having a central hub portion 23 is rotated by a driven shaft designated 24. The shaft rotates a pinion gear 26 engaging a drive gear 28 which, in the presently preferred practice, is disposed at right angles to the pinion 26. As gear 28 rotates, it drives a shaft 30 to which the removable rotor 22 is attached. The rotor can be mated to the shaft 30 by various means, one acceptable means being the provision of flat mating surfaces on the exterior of shaft 30 and the interior of rotor 22 which lock the rotor and shaft.

As shown, the rotor 22 has radially extending vanes 32 located at the upper end thereof. The lower end of the rotor 22 opposite the vaned portion has a radially extending flange or platform 36 shown with a plurality of steps or teeth 38 on the platform's upper surface. As the rotor 22 rotates counterclockwise, the teeth 38 grip the ice in the storage bin 12 and move the ice into a removable scoop shown generally by reference numeral 40. The scoop has a guide or deflecting member 42 as shown fully in FIG. 1, which directs ice into the channel 44 within the scoop as illustrated in FIGS. 1 and 2, guide 42 has a leading edge 43 spaced closely adjacent and conforming to hub 23 and a bottom edge **43*a*** (FIG.

2) spaced closely adjacent flange 36 and teeth 38. As shown in FIG. 2, an upper panel member 43*b* is integrally formed with or connected to guide 42 and extends horizontally to the right side of bin 12. A deflecting member 42 directs the circumferentially moving ice from flange 36 radially outwardly toward discharge channel 44. The close proximity of the leading edge 43 and bottom edge 43*a* to the hub 23 and flange 36, respectively, insures that loose ice or ice frozen to a portion of the rotor will be deflected in a manner that substantially minimizes chipping, jamming, or any tendency to bypass the scoop. Upper panel member 43*b* shields deflected ice from the ice immediately above, thereby permitting ice to flow unimpeded toward discharge channel 44.

The bin 12 has a plurality of apertures 37 therein which allow ice chips to fall on to the shelf 14. This prevents ice chips from being dispensed and allows the accumulation of chips until removal is convenient.

Attached to the rotor 22 is a removable wiper or spider 46 having four arms 48 extending generally radially therefrom, the spider being held in place by a nut 47. The arms 48 also tend to move the ice within the storage bin 12. The arms 48 also provide a means whereby ice which is not dispensed is moved past the scoop 40 and back into the storage area for recycling. The arms 48 also tend to break any clumps of ice which may have formed in the storage bin 12. It will be understood that although four arms 48 are shown in the figures, the spider 46 may have from one to eight arms and still function efficiently. The wiper is not necessary but is a preferred embodiment since it helps keep the ice from forming clumps and helps clear the area around the scoop 40.

The drive mechanism 24 derives its power from a gear reduction train 52 powered by an electric motor 50. The gear reduction train 52 turns a shaft 54 which in turn moves pinion 26. The shaft 54 has a coupling 55 comprising a male coupling 55*a* and a female coupling 55*b*. This coupling allows the bin and associated dispensing ports to be separated from the power source when bin cleaning is indicated. After cleaning, the coupling 55 is reunited and the dispenser is ready for further operation. The shaft 54 is supported by two hangers 56 which depend downward from a slanting surface 58 of bin 12. The motor and speed reduction train 52 determines the speed at which the pinion 26 rotates, the pinion being driven at a rate which turns the rotor at about 3 to 8 rpm, or 6.3 to 16.7 surface feet per minute at the outside edges of the rotor platform.

Shaft 54 also can be used to drive an agitator designated generally 60. The agitator 60 comprises an arm 66 with one end thereof pivotably mounted to the bin wall at 61. A cam 62 mounted on shaft 54 has one or more lobes thereon. The opposite end 63 of arm 66 has a cam follower 64 provided thereon which rides on the cam 62. As the shaft 54 rotates, the cam follower 64 and flat portion of arm 66 of agitator 60 oscillate in a vertical direction to break any clumps of ice which may form within the storage bin 12.

Figure 3:
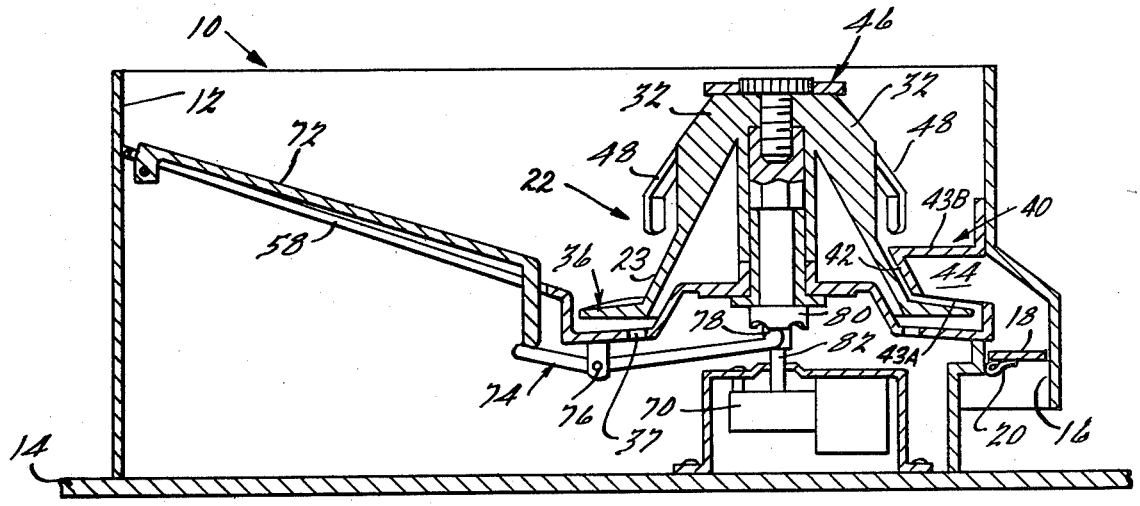
FIG. 3 is a second embodiment of this invention.

FIG. 3 shows a second embodiment wherein the rotor 22 is driven directly by an electric motor 70 with a gear reduction gear train. In this embodiment, an agitator 72 is moved by an oscillating lever arm 74 mounted intermediate the ends thereof on a pivot 76 attached to the bin wall 12 structure. The lever arm 74 has a cam folower 78 attached to the right-hand end in FIG. 3 which engages a cam 80 on a vertically disposed drive shaft 82. The remainder of the system is structurally similar to the embodiment of FIGS. 1 and 2 and operates as described hereinabove with reference to FIGS. 1 and 2.

Further modifications and alterations will become obvious to those skilled in the art without departing from the spirit of this invention, and it is understood that this invention is not limited to the specific embodiments set forth hereinbefore but encompasses that which is defined by the following claims.

What is claimed is:

1. A dispenser for dispensing ice, comprising:

(a) bin means suitable for receiving and holding ice, said bin means including,
  (i) means defining a discharge port for delivering ice therethrough,
  (ii) scoop means operable to receive and direct the ice into said discharge port;

(b) rotor means rotatably mounted in said bin means, said rotor means having gripping means operative upon rotation of said rotor means to receive ice from said bin means and move said ice circumferentially therewith and into said scoop means, said rotor means including,
  (i) hub means,
  (ii) flange means extending generally radially outwardly from the base of said hub means;

(c) said scoop means including a deflecting member having an edge spaced closely adjacent and conforming to said hub means, and another portion spaced closely adjacent said gripping means, said deflecting member effective for channeling ice into said discharge port and preventing ice from bypassing said scoop means;

(d) drive means adapted for connection to a source of power and operable upon activation to rotate said rotor means, and (e) activation means operable upon selective actuation by the user to activate said drive means.

2. A dispenser for dispensing ice, comprising:

(a) bin means suitable for receiving and holding ice, said bin means including,
  (i) means defining a discharge port for delivering ice therethrough;
  (ii) scoop means operable to receive and direct ice into said discharge port;

(b) rotor means rotatably mounted in said bin means, said rotor means having gripping means operative upon rotation of said rotor means to receive ice from said bin means and move said ice circumferentially therewith and toward said scoop means, said rotor means including,
  (i) hub means,
  (ii) flange means extending generally radially outwardly from the base of said hub means;

(c) said scoop means including
  (i) a deflecting member having a front edge portion spaced closely adjacent and conforming to said hub means,
  (ii) an upper panel member connected to the upper edge of said deflecting member and extending to said bin means for shielding and isolating the ice therein from the ice located immediately above said upper panel member;

(d) drive means adapted for connection to a source of power and operable upon activation to rotate said rotor means; and (e) activation means operable upon selective actuation by the user to activate said drive means.

3. The dispenser of claim 1 or 2, wherein said bin means under said flange defines an opening for permitting ice chips to pass therethrough to a location exteriorly of said bin means.

4. A dispenser for dispensing ice, comprising:

(a) bin means suitable for receiving and holding ice, said bin means including,
  (i) means defining a discharge port for delivering ice therethrough,
  (ii) scoop means operable to receive and direct the ice into said discharge port;
(b) rotor means rotatably mounted in said bin means, said rotor means including,
  (i) hub means,
  (ii) flange means extending generally radially outwardly from the base of said hub means;
(c) said bin means defines an opening proximate said flange means for permitting ice chips to pass therethrough to a location exteriorly of said bin means;
(d) drive means adapted for connection to a source of power and operable upon activation to rotate said rotor means, and
(e) activation means operable upon selective actuation by the user to activate said drive means.

5. The dispenser of claim 1, 2, or 4, wherein said rotor means includes a wiper operable upon movement of said rotor means to move ice which is not directed into said scoop means about said bin means for recycling.

6. The dispenser of claim 1, 2, or 4 wherein said bin means includes means operable to aid gravity flow of ice into contact with said rotor means.

7. The dispenser as defined in claim 2 wherein said deflecting member includes a bottom edge spaced closely adjacent said gripping means, said deflecting member effective for channeling ice into said discharge port and preventing ice from bypassing said scoop means.

8. The dispenser of claim 1, 2, or 4 wherein said rotor means is substantially vertically disposed in said bin means.

9. The dispenser of claim 1, 2, or 4 wherein, (a) said rotor means is substantially vertically disposed in said bin means;
(b) said bin means includes an inclined bottom surface portion which slants downwardly toward said rotor means; and further including
(c) agitator means disposed in said bin means, said agitator means including an elongated arm pivotally mounted at one end thereof to said inclined bottom surface and operably connected to said drive means at the other end thereof for oscillatory motion of said arm about said pivotal mounting.

* * * * *